United States Patent [19]

Waxham

[11] 4,098,288

[45] Jul. 4, 1978

[54] AIR LOGIC CONTROL CIRCUIT

[75] Inventor: Warren Arthur Waxham, Jamestown, N.Y.

[73] Assignee: Weber-Knapp Company, Jamestown, N.Y.

[21] Appl. No.: 760,711

[22] Filed: Jan. 21, 1977

[51] Int. Cl.[2] ..... F15B 13/04

[52] U.S. Cl. ..... 137/596.1; 91/424; 137/614.19; 137/596

[58] Field of Search ..... 137/596, 596.1, 613, 137/614.19; 91/5, 424; 235/201 ME; 222/444, 450, 442

[56] References Cited

U.S. PATENT DOCUMENTS

| | | | |
|---|---|---|---|
| Re. 28,520 | 8/1975 | Mahorney et al. | 137/596 |
| 3,043,335 | 7/1962 | Hunt | 91/424 |
| 3,070,295 | 12/1962 | Glättli | 235/201 ME |
| 3,122,313 | 2/1964 | Glättli | 235/201 ME |
| 3,380,465 | 4/1968 | Rona | 235/201 ME |

*Primary Examiner*—Martin P. Schwadron
*Assistant Examiner*—A. Michael Chambers
*Attorney, Agent, or Firm*—Price, Heneveld, Huizenga & Cooper

[57] ABSTRACT

The specification discloses an air logic circuit with two, five port valves connected between an air supply and a volume chamber for supplying an output signal at an output port when both valves are activated substantially simultaneously. When both valves are in a released condition there is no output signal and the air supply is connected through the serial combination of both valves to a volume chamber. When either of the two valves is activated alone, the volume chamber is coupled to the atmosphere through an exhaust orifice. When both valves are simultaneously activated, the volume chamber is coupled to an output through the serial combination of both valves.

7 Claims, 4 Drawing Figures

AIR LOGIC CONTROL CIRCUIT

BACKGROUND OF THE INVENTION

This invention relates in general to pneumatic control apparatus; and, more particularly, to an improved two-button air logic control for a machine or the like.

The prior art teaches two-button control systems for various machines which require the use of both hands thus ensuring an operator's hands are clear of machine operation. There are known systems which combine pneumatic control operation with mechanical control operation. For example, a safety control mechanism for use in controlling the operation of power driven machinery requires the simultaneous operation of two handles controlling air valves of a pneumatic system. Further, mechanical engagement between the handle and the controlled machinery is used in conjunction with the air control valves to prevent undesired operation. Such a system has an undesirably high degree of complexity and requires fabrication and maintenance of both pneumatic and mechanical systems.

Use has also been made in the prior art of a purely pneumatic system having two control buttons for controlling operation of hazardous machines. Nevertheless, although only two control buttons have been required, typically the pneumatic control system includes three or more valves in combination with exhaust ports and orifices of restricted cross section. For example, there is typically a two stage operational sequence using two palm button operated valves which operate two or three relay valves which in turn supply an output signal; that is, manually operated valves activate other valves which produce an output for controlling a machine. Further, in some such systems orifices having equally matched cross sectional areas are required. Such requirements add to the cost and complexity of a pneumatic control system. Indeed, more generally, fabrication and maintenance of such systems typically have an undesirable degree of complexity and a correspondingly undesirable high cost. Thus, the problem of having a simple, low cost pneumatic control system has not been effectively solved. These are among the deficiencies of existing control systems the present invention overcomes.

SUMMARY OF THE INVENTION

The invention includes an air logic control circuit having two, five port valves connected serially between an air supply and a volume chamber. Both of the valves are individually operable between a released condition and an activated condition. When both valves are in the released condition, the air supply is in communication with the volume chamber through the serial combination of both of the valves. When either of the two valves is individually activated, the volume chamber is isolated from the air supply and is in communication with an exhaust orifice through the serial combination of the two valves thereby discharging the volume chamber to the atmosphere. If both of the valves are activated essentially simultaneously, the volume chamber is isolated from both the air suppply and the exhaust orifice and in communication with an output port through the combination of both of the valves.

As already noted, for safety reasons, it is desired that both hands be used simultaneously to operate the valves thereby positioning the hands out of the way of an operating machine. That is, securing one valve in the activated condition and then operating the other valve so it is in the activated condition should not produce an output. An embodiment of this invention is particularly useful because relatively simple components are coupled in such a way to provide for a control system having a two-hand no tie down feature. In particular, only two valves, each associated with a push button, are included in the control system governing the operation of the machine. Further, since only a single orifice is used there is no problem of matching the size of one orifice with the size of another orifice to obtain the desired maximum time interval between sequential valve operations to obtain an output signal. Instead, the permissible time interval between actuation of the two valves to obtain an output is determined by more readily controlled variables such as the size of the single exhaust orifice and the size of the volume chamber. As a result, an embodiment of this invention provides an advantageously reduced component cost and reduced assembly cost. Additionally, a control circuit in accordance with an embodiment of this invention is more reliable and more suitable for heavy duty use because of its simplicity.

In accordance with an embodiment of this invention, the output signal can be selected to be either a momentary pulse or a continuous signal. A momentary pulse signal is obtained by coupling the output so activating both valves produces a signal at the output port and then releasing both valves couples the exhaust orifice to the output port thus terminating the output pulse initiated when both of the valves were activated. A continuous signal is obtained by coupling the output so activating both valves produces a signal at an auxiliary output port and then releasing both valves so the output port is sealed with respect to both valves. That is, unless the triggering circuitry of the machine coupled to the output provides a discharge path for the air, the output will be maintained at a constant pressure. If there is flow through a discharge path through the output or there is leakage through the valves, a volume chamber supplying such flow through the valves will become depleted and the output signal will cease.

DETAILED DESCRIPTION

Figure 1:
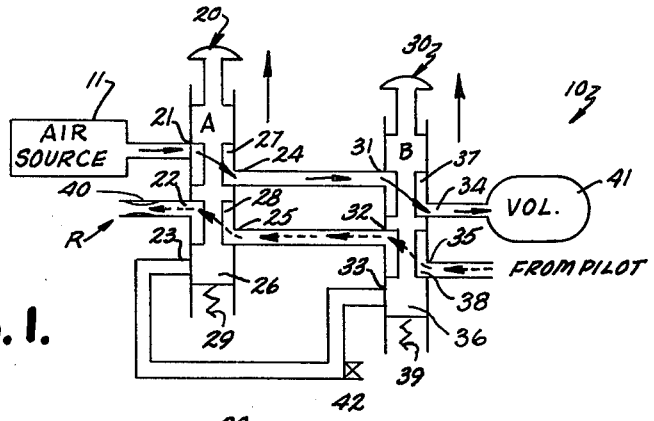
FIG. 1 is a schematic diagram of the air logic circuit in accordance with an embodiment of this invention wherein both valves are released so the volume chamber is in communication with the air.

Referring to the drawings, an air logic circuit 10 for controlling the operation of a machine has a pressurized air source 11 connected to a port 21 of a five port valve 20. Advantageously, air source 11 provides a regulated line pressure. Valve 20 also includes a port 24 connected to a port 31 of a five port valve 30, a port 25 connected to a port 32 of valve 30, and a port 23 connected to a port 33 of valve 30. A port 22 of valve 20 is connected to a restriction 40 so port 22 is in communication with the atmosphere through restriction 40. Valve 30 includes a port 34 coupled to a volume chamber 41 and a port 35 coupled to an output. Additionally, an auxiliary output 42 is coupled to port 23 of valve 20. The output at port 35 is adapted to supply a pulse output and the auxiliary output 42 coupled to port 23 is adapted to supply a continuous output. In FIGS. 1–4, auxiliary output 42 is shown in a plugged condition. The various connections between the ports of valves 20 and 30 can be, for example, formed of air tight metal tubing or bored passageways in a plastic block used to mount valves 20 and 30.

As is known, five-way valves can have movable internal plungers for selectively connecting the ports of the five-way valve. Typically, the plungers are spring biased to be in a released condition and can be manually moved to be in an activated condition. More specifically, valve 20 has a plunger 26 with two isolated chambers 27 and 28. Chamber 27 selectively connects port 24 to either port 21 or 22; and chamber 28 selectively connects port 25 to either port 22 or 23. Similarly, valve 30 has a plunger 36 having chambers 37 and 38 corresponding to chambers 27 and 28 of valve 20. Chamber 37 selectively connects port 34 to either port 31 or 32; and chamber 38 selectively connects port 35 to either port 32 or 33. As already noted, a spring associated with a plunger within a valve biases the valve plunger to a released position. As shown schematically in FIGS. 1–4, a spring 29 is associated with plunger 26 and a spring 39 is associated with plunger 36. When plungers 26 and 36 are in an activated condition, ports 21 and 31 are blocked, and when plungers 26 and 36 are in a released condition, ports 23 and 33 are blocked.

The cross-sectional area of restriction 40 determines the rate of discharge of air from volume chamber 41 when volume chamber 41 is in communication with restriction 40. Advantageously, restriction 40 has a sufficiently narrow cross section to maintain sufficient pressure in volume chamber 41 to activate an output long enough to sequentially activate valves 20 and 30 within a desired time interval. In other words, restriction 40 must be sized such that when only one valve is activated, pressure in volume chamber 41 drops to below the minimum operating pressure of a pilot activating a controlled device in a specified time interval. If the other valve is then activated, a machine triggering pilot coupled to either output 35 or 42 will not be activated.

As an example of particular components which may be used in an embodiment of this invention, valves known in the art as "Humphrey 41P" valves can be used for valves 20 and 30, units known in the art as "Clippart MAT-1.0" can be used for volume chamber 41, and "Humphrey 97-21" can be used for restriction 40. The output from air logic circuit 10 can be used to activate any air piloted device which uses an air pilot such as valves known as "Humphrey 34A" or "Humphrey 34AS".

OPERATION

Referring to FIG. 1, valves 20 and 30 are both shown in an at rest or released configuration. Air source 11 is connected to volume chamber 41 through port 21, chamber 27 and port 24 of valve 20 and port 31, chamber 37 and port 34 of valve 30. Ports 22, 23 and 25 of valve 20 are isolated from air source 11 and volume chamber 41. Similarly, ports 32, 33 and 35 of valve 30 are isolated from air source 11 and volume chamber 41. In this configuration, the pressure within volume chamber 41 equalizes with the pressure from air source 11. The path between volume chamber 41 and air source 11 is chosen to have a sufficiently large cross section so the air pressure within volume chamber 41 rises to the air pressure of air supply 11 quickly relative to the desired operational cycle time of air logic circuit 10.

Figure 2:
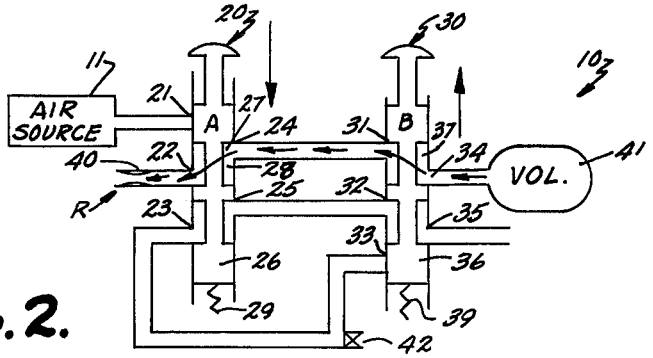
FIG. 2 is a schematic diagram of the air logic circuit of FIG. 1 wherein the first of the two valves is activated and the second of the two valves is released so the volume chamber is in communication with the exhaust orifice.

Referring to FIG. 2, valve 20 is in an activated condition and valve 30 remains unchanged from the configuration from FIG. 1 in a released condition. Ports 24 and 22 of valve 20 are connected and ports 21, 23 and 25 are isolated from air source 11 and volume chamber 41. Volume chamber 41 is serially connected to restriction 40 through port 34, chamber 41 is now connected to restriction 40 through port 34, chamber 37 and port 31 of valve 30 and through port 24, chamber 27 and port 22 of valve 20. Accordingly, with one valve activated, volume chamber 41 is cut off from the line air pressure supplied by air source 11, the air pressure within volume chamber 41 drops as air discharges through restriction 40 and there is no output at port 35.

The cross-sectional size of restriction 40 is chosen so both valves 20 and 30 must be activated within a desired time interval to provide a sufficient output at port 35. For example, the size of restriction 40 can be chosen so the pressure in volume chamber 41 falls below the minimum operating pressure of a pilot coupled to port 35 approximately one-quarter second after valve 20 is activated. If valve 30 is activated after this quarter second interval, with valve 20 still activated, the pilot will not be activated, because the pressure supplied by volume chamber 41 to the pilot would have already dropped below the minimum operating pressure of the pilot.

Figure 3:
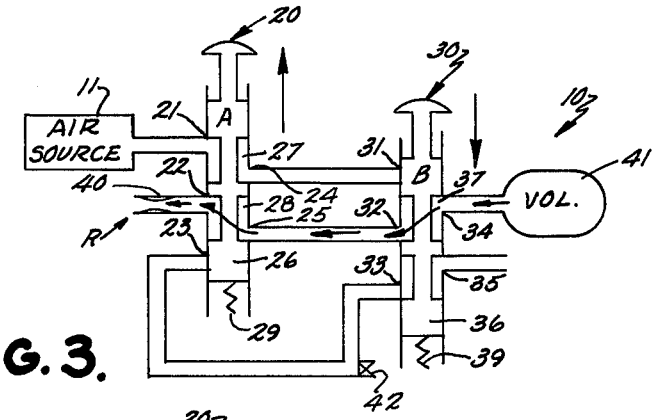
FIG. 3 is a schematic diagram of the air logic circuit of FIG. 1 wherein the first valve is released and the second valve is activated so the volume chamber is in communication with the exhaust orifice.

Analogous to the situation in FIG. 2, FIG. 3 shows valve 30 activated and valve 20 remaining a released or at rest condition. Volume chamber 41 is connected to restriction 40 through port 34, chamber 37 and port 32 of valve 30 and through port 25, chamber 28 and port 22 of valve 20. Again the air pressure within volume chamber 41 discharges to the atmosphere through restriction 40 and there is no output at port 35.

Figure 4:
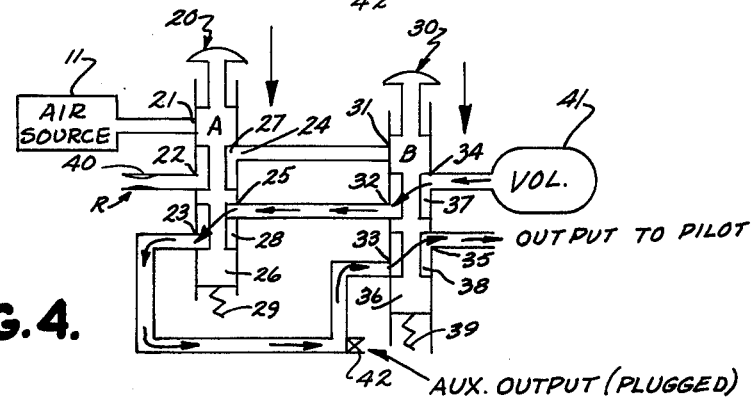
FIG. 4 is a schematic diagram of the air logic control circuit of FIG. 1 wherein both of the valves are activated so the volume chamber is in communication with the output.

Referring to FIG. 4, both valves 20 and 30 are in an activated condition. As a result, volume chamber 41 is connected to port 35 and supplies an output to any pilot coupled to port 35. More specifically, volume chamber 41 is connected to port 35 sequentially through port 34, chamber 37, port 32, port 25, chamber 28, port 23, port 33, chamber 38, and port 35. If valves 20 and 30 are activated almost simultaneously, for example, within one-quarter second of each other, volume chamber 41 is cut off from the line pressure supplied by air source 11 and the pressure from volume chamber 41 is directed to output port 35 coupled to the pilot of a device to be activated. As a result of the essentially simultaneous activation of valves 20 and 30, the pressure directed to the pilot has not had time to drop, by exhausting through restriction 40, below the minimum pressure required to activate the pilot. The pressure in volume chamber 41 and in the air path to the pilot will remain above the minimum operating pressure for the pilot as long as valves 20 and 30 are activated. Restriction 40 is isolated from volume chamber 41 so pressure is trapped within air logic circuit 10 unless exhausted externally by the pilot. Returning valves 20 and 30 to the configuration shown in FIG. 1 where they are both released, air pressure at output port 35 is exhausted through restriction 40. As a result, the air pressure output at output port 35 is a pulse which lasts as long as both valves 20 and 30 are activated.

Alternatively, if it is desired to maintain continuously an air pressure at an output, port 35 can be plugged, auxiliary output 42 can be unplugged, and the pilot to be activated coupled to output 42. The presence of an output at auxiliary output 42 occurs whenever there would have been an output at port 35. That is, when both valves 20 and 30 are activated substantially simultaneously. Additionally, when valves 20 and 30 are both released as shown in FIG. 1, auxiliary output 42 is not coupled to restriction 40, does not exhaust to the atmosphere and is isolated from all other ports. Accordingly, the pressure is trapped in any pilot connected to auxiliary output 42 and the pilot remains activated. Pilot pressure at auxiliary output 42 must be exhausted externally to deactivate the pilot. That is, air can be exhausted through the pilot itself.

Various modifications and variations will no doubt occur to those skilled in the various arts to which this invention pertains. For example, the pilot to be activated can be coupled to a switching means which is in turn coupled to ports 35 and 42. The switching means can be operated to selectively connect the pilot to either port 35 or port 42 as desired. Such a variation and all other variations which basically relay on the teaching for which this disclosure has advanced the art are properly considered within the scope of this invention as defined by the appended claims.

The embodiments of the invention in which an exclusive property or privilege is claimed are defined as follows:

1. An air logic system comprising:

a multiple port first air valve selectively operable between a first and a second position;

an exhaust orifice coupled to one port of said first valve;

a multiple port second air valve selectively operable between a first and a second position;

a volume chamber means coupled to one port of said second valve;

an output means coupled to one port of said second valve;

said exhaust orifice providing an exhaust port to the atmosphere for said volume chamber, said exhaust orifice having a sufficiently small cross section so that a connection to said volume chamber during a relatively small duration of time does not substantially change the pressure within said volume chamber thereby maintaining the pressure within said volume chamber at a level sufficient to provide an output at said output means; and connecting means for passing air between ports of said first and second valves so when said first and second valves are in said first position an air supply path is coupled through the combination of said first and second valves to said volume chamber means; when said first valve is in said second position and said second valve is in said first position said volume chamber means is coupled through the serial combination of said first and second valves to said exhaust orifice; when said first valve is in said first position and said second valve is in said second position said volume chamber means is coupled through the serial combination of said first and second valves to said exhaust orifice; and when said first and second valves are in said second positions an output air path is coupled from said volume chamber through the serial combination of said second valve, said first valve and said second valve to said output means for supplying an output air pressure level, suitable for actuating the operation of a machine, after substantially simultaneous operation of said first and second valves to said second positions; said output path being coupled to said exhaust orifice when said first and said second valves are in said first position.

2. An air logic circuit as recited in claim 1 wherein said connecting means includes an auxiliary output air path from said volume chamber means when said first and second valves are in said second positions, said auxiliary output air path including the serial combination of said first valve and said second valve, and being blocked when said first and second valves are in said first positions.

3. An air logic circuit as recited in claim 2 wherein said first and second valves each have five ports, and each of said first and second valves has a plunger with two chambers, each chamber coupling two ports within a five port valve, said first valves including a first port, a second port, a third port, a fourth port, a fifth port, a first chamber and a second chamber, and said second valve having a sixth port, a seventh port, an eighth port, a ninth port, a tenth port, a third chamber and a fourth chamber.

4. An air logic circuit as recited in claim 3 wherein:

said exhaust orifice is coupled to said third port;

said volume chamber is coupled to said seventh port;

said air supply path includes said first port, said second port, said first chamber, said sixth port, said seventh port, and said third chamber;

said output air path includes said seventh port, said third chamber, said eighth port, said fourth port, said second chamber, said fifth port, said tenth port, said fourth chamber, and said ninth port;

said volume chamber being coupled to said exhaust orifice through said seventh port, said third chamber, said sixth port, said second port, said first chamber and said third port when said first valve is in said second position and said second valve is in said first position;

said volume chamber being coupled to said exhaust orifice through said seventh port, said third chamber, said eighth port, said fourth port, said second chamber, and said third port when said first valve is in said first position and said second valve is in said second position; and said auxiliary output air path includes said seventh port, said third chamber, said eighth port, said fourth port, said second chamber and said fifth port.

5. An air logic system comprising:

a first five port valve having a first port, a second port, a third port, a fourth port and a fifth port, said first valve being operable between a first activated position and a first released position thereby selectively forming two pairs of connected ports and blocking the one remaining port of said first valve;

said first released position putting in communication said first port with said second port, said third port with said fourth port and blocking said fifth port, and said first activated position putting in communication said second port with said third port, said fourth port with said fifth port and blocking said first port;

a second five port valve having a sixth port, a seventh port, an eighth port, a ninth port, and a tenth port, said second valve being operable between a second activated position and a second released position thereby selectively forming two pairs of connected ports and blocking the one remaining port of said second valve, said second released position putting in communication said sixth port with said seventh port, said eighth port with said ninth port and blocking said tenth port, and said second activated position putting in communication said seventh port with said eight port, said ninth port with said tenth port and blocking said sixth port;

said first port being adapted to be coupled to an air supply means and being in communication with said second port in said first released position and blocked when said first valve is in said first activated position;

a restricted orifice coupled to said third port, thereby being in communication with said fourth port in said first released position and in communication with said second port in said first activated position;

a volume chamber means coupled to said seventh port, thereby being in communication with said sixth port in said second released position and in communication with said eighth port in said second activated position;

a first connecting means coupling said second port and said sixth port;

a second connecting means coupling said fourth port and said eighth port;

a third connecting means coupling said fifth port and said tenth port; and said ninth port in communication with said volume chamber means during the simultaneous occurrence of said first activated position and said second activated position, for supplying an output air pulse after the simultaneous occurrence of said first activated position and said second activated position.

6. An air logic system as recited in claim 5 further comprising:

an output plug coupled to said ninth port for closing off said ninth port and preventing passage of air; and an auxiliary output in communication with said tenth port for providing an output air pressure level during the substantially simultaneous occurrence of said first activated position and said second activated position, and isolating such an output air pressure level from said restricted orifice during the occurrence of said first released position.

7. An air logic system as recited in claim 6 wherein said restricted orifice is sufficiently small in cross section so there remains a sufficiently high air pressure in said volume chamber means to actuate an output when the time interval between operating said first valve to said first activated position and said second valve to said second activated position is under one-fourth second.

* * * * *